United States Patent [19]

Wagster et al.

[11] 4,378,107

[45] Mar. 29, 1983

[54] WORKPIECE SUPPORT AND CLAMPING ASSEMBLY

[75] Inventors: Robert P. Wagster; Russell Pizzuto, both of Easton, Md.

[73] Assignee: Black & Decker Inc., Newark, Del.

[21] Appl. No.: 303,115

[22] Filed: Sep. 17, 1981

Related U.S. Application Data

[63] Continuation-in-part of Ser. No. 134,804, Mar. 28, 1980, abandoned.

[51] Int. Cl.[3] ..... B25B 1/22

[52] U.S. Cl. ..... 269/95; 269/139; 269/219; 269/901; 108/134; 108/160

[58] Field of Search ..... 269/901, 139, 101, 95, 269/219-220; 144/285, 286 R; 108/160, 134, 152, 27; 312/313; 248/240, 240.4; 292/278, 263, 267, 270, 274

[56] References Cited

U.S. PATENT DOCUMENTS

| | | | |
|---|---|---|---|
| 1,852,990 | 4/1932 | Wandtke | 292/263 |
| 1,951,888 | 3/1934 | Tinsley | 108/160 |
| 3,113,533 | 12/1963 | Snow | 108/134 |
| 3,499,675 | 3/1970 | Isenberg | 292/278 X |
| 4,073,484 | 2/1978 | Beekenkamp | 269/901 |
| 4,155,609 | 5/1979 | Skafte et al. | 269/901 X |

*Primary Examiner*—Robert C. Watson

*Attorney, Agent, or Firm*—Edward D. Murphy; Walter Ottesen; Harold Ottesen

[57] ABSTRACT

A workpiece supporting and clamping assembly is adapted to be mounted on a wall or similar structure and to be adjustable between a substantially vertical storage position, closely adjacent the wall and a working position substantially perpendicular to the wall. The assembly comprises a pair of brackets, a pair of spaced apart, parallel hinge assemblies, each having locking means and a release lever associated therewith, and a workpiece supporting and clamping device, pivotally coupled with the brackets and hinge assemblies. The workpiece supporting and clamping device comprises a generally rigid base frame which includes a pair of parallel, spaced apart frame members and a pair of elongated, coplanar top members which are mounted on the spaced apart members, extending generally transversely thereto such that their upper surfaces define the work supporting surface and their opposed side surfaces, the work clamping surfaces. The supporting and clamping structure is pivotally mounted, to the brackets and to the hinge assemblies, which are pivotally interconnected with the brackets. When the workpiece supporting and clamping assembly is in its storage position, the hinge assemblies are collapsed. When the assembly is brought to its working position, the hinge assemblies are extended and lock securely in extended position supporting the supporting and clamping structure and in its working position until both hinge assemblies are affirmatively released by means of their respective release levers.

4 Claims, 9 Drawing Figures

WORKPIECE SUPPORT AND CLAMPING ASSEMBLY

CROSS REFERENCE

This is a continuation-in-part of co-pending U.S. patent application Ser. No. 134,804 filed Mar. 28, 1980 and now abandoned.

FIELD OF THE INVENTION

The present invention relates to workpiece supporting and clamping devices. More particularly, the present invention pertains to workpiece supporting and clamping devices which are mountable on a vertical support surface and wherein the workpiece supporting and clamping devices are adjustable between substantially vertical and horizontal positions.

BACKGROUND OF THE INVENTION

Workbenches of the type having a workpiece clamping device as part of its basic structure, as taught in U.S. Pat. No. 3,615,087, dated Oct. 26, 1971 to R. P. Hickman, have enjoyed substantial economic success. Workbenches of this variety generally include a pair of coplanar top members, one a stationary member, the other top member being adjustable toward and away from the first member by means of independently actuable screw type clamping devices which permit angular adjustment of the moveable member relative to the fixed member to permit secure clamping of tapered workpieces.

The workbenches of this type known in the prior art are generally bench top structures, adapted to be emplaced on a table or bench top, or comprise standing units which may be provided with foldable support structures. However, both varieties of workbenches require substantial storage space. In limited work areas, the table top workbenches must be physically moved and any work in progress disturbed in order to clear the worktable or bench of other uses.

Work surface support arrangements in which work surfaces are supported from support structures in working or storage positions are known in the art. In general, while a great variety of hinge mechanisms for pivoted work surfaces have been used in the past, they have been intended for light duty uses or else have been supplemented by additional elements such as leg structures. Many such devices are not exposed to events which might cause accidental collapse or, if collapse does occur, the likely results are not of serious concern. For these various reasons, the hinge assemblies known in the prior art have generally been relatively light in construction. Those devices which have, in some instances, been of stronger construction are often very complicated or use supplementary supports such as legs or overhead hangers which are not always desirable.

The present invention overcomes these difficulties in the prior art by providing a workpiece supporting and clamping device which is adapted to be wall-mounted to provide rigid, stable and sturdy support for heavy duty work and tools without use of complicated structures or supplementary supports, and to store in a space-saving, generally vertical position adjacent the wall. In this manner, the present invention provides a workbench which requires neither table space nor floor space for use or storage and which may be stored compactly without disassembly or substantial physical effort.

SUMMARY OF THE INVENTION

According to the present invention, there is provided a workpiece supporting and clamping assembly particularly adapted to be mounted on a wall or similar support structure and comprising a workpiece supporting and clamping device, mounting brackets and a pair of parallel, spaced apart hinge assemblies, each hinge assembly having a dual locking means and a release lever associated therewith.

The workpiece supporting and clamping device hereof is a workbench device of the type which comprises a generally rigid base frame having a pair of parallel, spaced apart frame members and a pair of elongated, coplanar top members which are mounted generally transversely across the spaced apart frame members. In this configuration, the upper surfaces of the top members define a work support surface and their opposing, side surfaces define workpiece clamping surfaces. A first top member is fixedly mounted to the frame and the second top member is adjustably mounted and is movable toward and away from the first member by means of independently actuable screw-type devices which permit angular adjustment of the movable member, relative to the fixed member to provide secure clamping of tapered or irregularly shaped workpieces.

The workbench device is pivotally mounted at a first end thereof to a pair of mounting brackets by which means the workbench is mounted on a wall or similar support structure.

A particular feature of the invention is a uniquely rigid and stable hinge assembly whereby the workbench may be locked securely and rigidly in its extended, working position. Once locked into working position, generally perpendicular to the wall, the workbench will not collapse under substantial weight or pressure exerted by a worker, and cannot be collapsed accidentally by inadvertent jarring of the hinge mechanism. Once locked into working position, the workbench can be returned to its storage position only by release of both hinge assemblies by means of their respective release levers.

The hinge assemblies are pivotally coupled at a first end thereof with the mounting brackets at a point thereon remote from that at which the workbench is mounted, and, at a second end thereof, are pivotally coupled with the workbench at positions remote and equally spaced from the points at which the workbench is mounted to the brackets. Each hinge assembly is provided with an over-center locking means and a self-actuating locking means which retain the workbench rigidly in its working position, and which are released by means of release levers associated therewith. Once in its working position, the workbench may be lowered to its storage position only by collapse of both hinge assemblies by actuation of their respective release levers. The locking means hereof precludes collapse of the hinge mechanism by jarring of the hinges and each hinge mechanism has sufficient rigidity to retain the workbench securely in working position alone, if the other hinge assembly is released.

Thus, it is an object of the present invention to provide a work supporting and clamping assembly which is wall mounted, requires little storage space and which may be set up in working position and returned to its storage position without inconvenience or physical exertion.

It is a further object of the present invention to provide a wall mounted work supporting and clamping device which is rigidly supported, which locks securely into working position, and which is not susceptible to accidental collapse under substantial weight, pressure, or inadvertent jarring.

It is a further object of the present invention to provide a sturdy, stable and rigidly braced workbench, amenable to heavy duty work, which is vertically suspended and does not require the placement of legs or other obstructions beneath the work area.

It is still a further object of the present invention to provide a wall mounted work supporting and clamping device with novel, locking hinge assemblies which permits the device to be stored in place on the wall, substantially vertically, adjacent thereto.

It is still a further object of the present invention to provide a vertically suspended workbench with novel, locking hinge assemblies, each assembly being independently operable to lock the device securely in its working position, such that the assembly will not collapse even upon inadvertent jarring or release of one hinge assembly, and each assembly having a release lever associated therewith so that only by actuation of both levers may the device be collapsed to storage position.

Additional objects and advantages of the present invention will become apparent when the following description of the preferred embodiment is read in conjunction with the drawings in which:

DESCRIPTION OF THE PREFERRED EMBODIMENT

Figure 1:
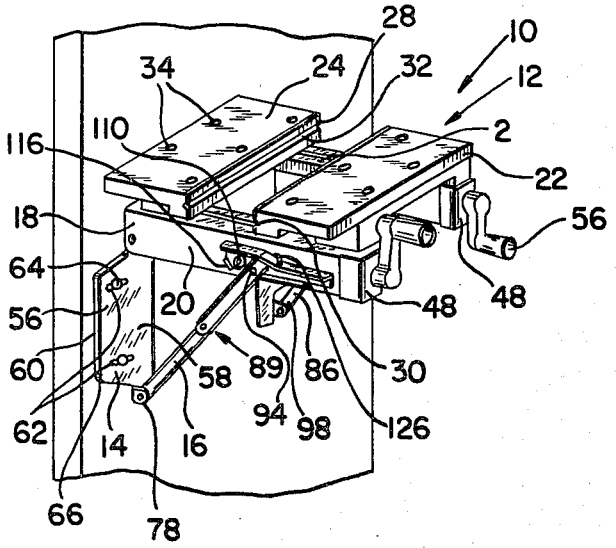
FIG. 1 is a front perspective view of the work supporting and clamping assembly hereof in its working position.
Figure 2:
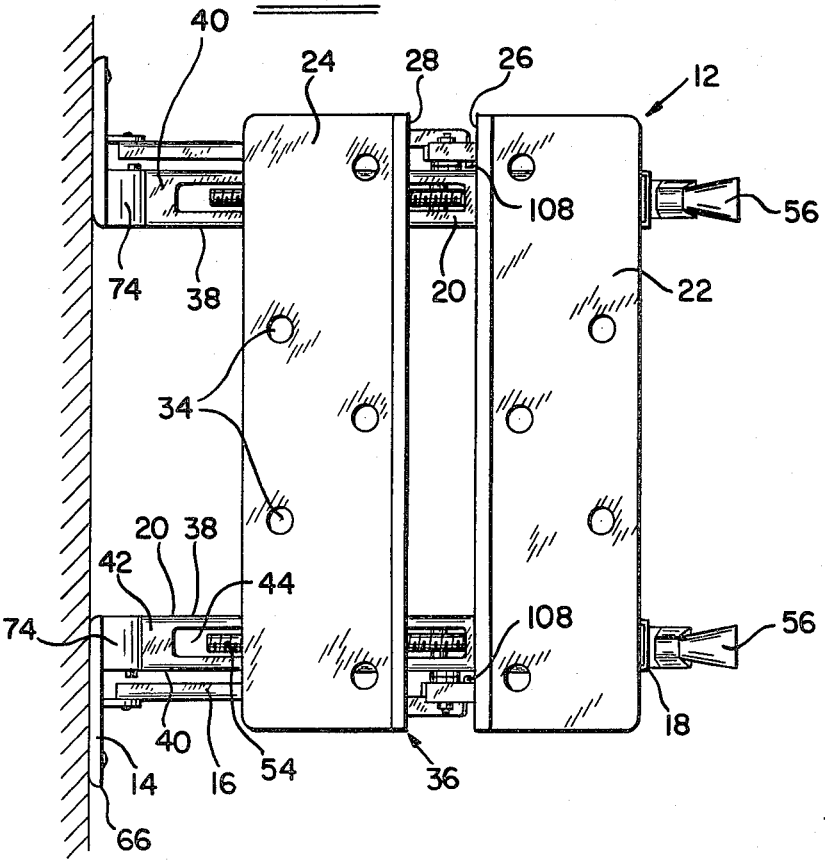
FIG. 2 is a top plan view hereof.
Figure 4:
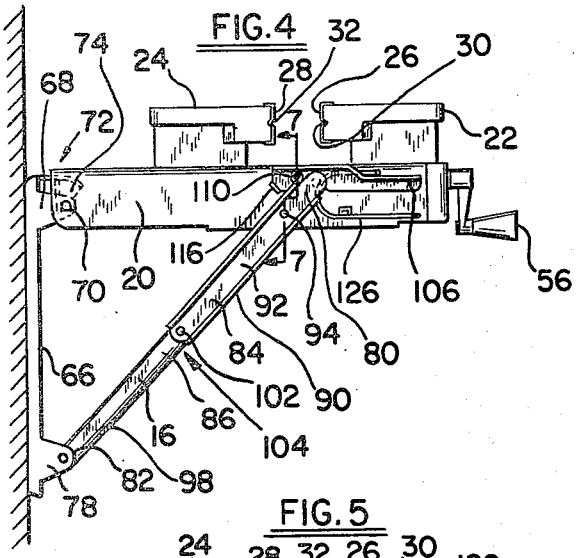
FIG. 4 is a side view hereof.
Figure 7:
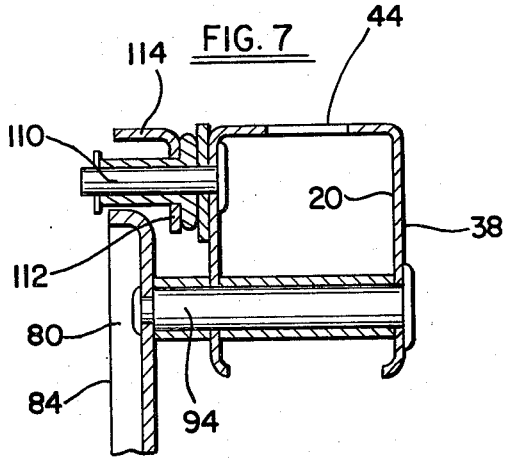
FIG. 7 is a cross-sectional view hereof taken along line 7—7 of FIG. 4.

Now and with reference to FIGS. 1 and 2, there is denoted generally at 10 a work supporting and clamping assembly. The assembly 10 comprises a work supporting and clamping device or workbench indicated generally at 12, mounting brackets 14, and a pair of parallel hinge assemblies 16.

The workbench 12 of the preferred embodiment comprises a rigid, base frame 18, defined by a pair of spaced apart channel members 20. The channel members 20 comprise support members for the clamping assembly and are constructed from a relatively heavy gauge sheet metal or similar material in order to provide a strong and durable frame that is not susceptible to distortion under stress. The workbench 12 further comprises a pair of elongated, coplanar top members 22, 24 which are mounted across and generally transverse to said channel members 20. The top members 22, 24 may preferably be somewhat longer than the distance between the channel members 20 and may extend a short distance on either side thereof. Normally, the top members 22, 24 are coextensive.

The coplanar top members 22, 24 may comprise laminated wood beams or planks formed from a similar, suitable material and preferably have relatively broad, rectangular top planar surfaces which define table-like working surfaces. The top members 22, 24 further define a pair of opposed clamping or vise jaws, the first or front member 22 being a stationary vise jaw, fixedly mounted to the channel members 20, and the second or rear member 24 being an adjustable or movable vise jaw, movably mounted on the channel members 20 for movement toward and away from the stationary jaw member 22. The opposing side portions 26, 28 respectively, of the top members 22, 24, define the clamping surfaces between which a workpiece may be secured. Excellent results are achieved where the opposing, clamping surfaces 26, 28 are provided with longitudinally extending, V-shaped channels 30, 32 respectively, therein to facilitate secure gripping of articles having convex surfaces, such as pipes and the like, therebetween. To facilitate clamping of irregularly shaped workpieces not susceptible to clamping between the clamping surfaces and channels hereinabove described, the top members 22, 24 may further be provided with a plurality of apertures 34, preferably spaced apart on the two surfaces, forming a mirror-symmetrical array therebetween, extending therethrough, substantially perpendicular to the work surfaces. The apertures are configured to securely receive clamping pegs (not shown) or similar, workpiece engaging supports.

Figure 3:
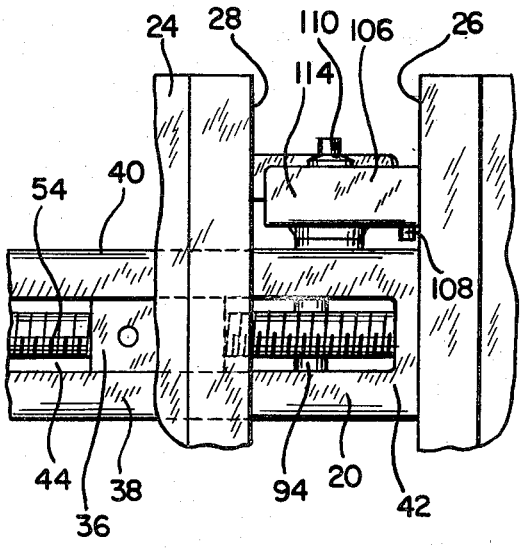
FIG. 3 is a top plan view of the locking means and release lever hereof.

The movable jaw 24 is moved toward and away from the stationary member 22 by means of two screw actuated clamping means 36, each of which is independently actuable to move its respective end of the movable jaw toward or away from the stationary member. As best seen in FIGS. 2 and 3, each channel member 20 has an integral, rectangular, box beam type construction defined by a pair of parallel side walls 38, 40 connected by a bight portion 42 extending therebetween. Each bight portion 42 is provided with a longitudinally extending cut out portion 44 for receiving the clamping means 36 therethrough. Each channel member 20 is further provided with an end piece 48 which encloses the end of the channel members proximate the stationary member 22.

Figure 8:
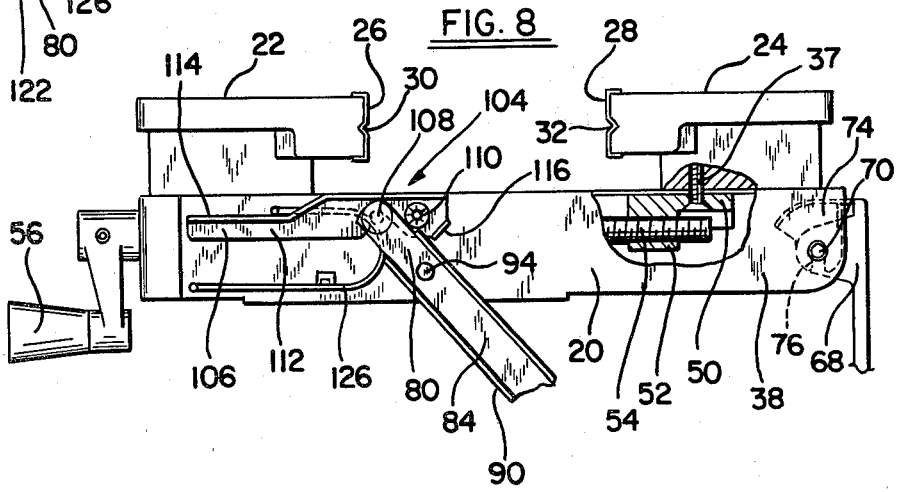
FIG. 8 is a side view of the locking means and release lever hereof in locking position.

With particular reference to FIG. 8, the clamping means 36 are mounted to the lower surface of the movable member 24 by any suitably secure mounting means such as screws 37, and extend down into the channel members 20 through the cut out portions 44. Each clamping means comprises a support structure 50 and an internally threaded, tubular member 52. The movement of the top member 24 is effected by means of threaded shafts 54 which extend longitudinally through the channel members 20 and, through the end pieces 50. Each shaft 54 is provided with a crank 56 which is operable by manual rotation to turn the shaft. The shafts 54 are dimensioned to fit telescopingly within the tubular members 52 of the clamping means 36 and the threading of the shafts 54 is complementary to and interengageable with that of the tubular members 52 such that rotation of the shafts 54 in a clockwise or counterclockwise direction by means of the cranks 56 will cause the clamping means, along with the movable top member 24 mounted thereto, to ride along the threaded shafts 54 thereby selectively moving the top member 24 toward or away from the stationary member 22 to effect the clamping or release of a workpiece therebetween.

It is to be appreciated that each clamping means 36 is independently actuable and that rotation of only one crank 56 will effect angular movement of the movable member 24 relative to the stationary member. Each clamping means is adapted to permit each end of the movable top member 24 mounted thereon to pivot with respect to the other end, to permit said moveable member to move angularly with respect to said stationary member.

This capacity for angular adjustment is particularly advantageous in circumstances wherein it is desired to clamp a tapered workpiece in that it permits rigid abutting engagement between the clamping surfaces and areas of the workpiece having sloping sides. Moreover, said capacity for angular adjustment enables workpieces clamped at positions proximate the ends of the top members to be held more securely by angular adjustment of the movable member 24 to reinforce the clamping grip thereon.

The workbench 12 is mounted on a wall or similar, substantially vertical support structure by means of the mounting brackets 14. Each mounting bracket 14 comprises a downwardly extending base member 57 including a first, substantially vertical portion 58 having a width slightly smaller than that of the frame channel members 20 and an integral, outwardly directed extension 60 which preferably extends from its associated vertical portion 58 along a substantial portion of the length thereof. Each extension 60 is provided with mounting apertures 62 which may comprise substantially horizontal slots adapted to receive mounting hardware such as screws 64 therethrough.

The brackets 14 hereof are formed from high gauge metal to insure adequate strength and durability. Each downwardly extending base member 57 has an integral, upstanding wall 66 formed about its perimeter and mounting means, comprising a pair of integrally formed, opposing tabs 68 formed at the upper portions thereof. The pairs of mounting tabs 68 are parallel and are generally perpendicular to their respective base members 57, and are thus dimensioned to extend into their respective frame channel members 20. The mounting tabs 68 and the sidewalls 38, 40 of their respective frame channel members 20 are each provided with an aperture, (not shown) said apertures being deployed such that they will be brought into alignment when the mounting tabs 68 are emplaced within the frame channel members, in accordance herewith. The aligned apertures of each channel member 20, and associated mounting tabs 68 are adapted to receive a roll pin 70 therethrough to form a joint indicated generally at 72 between the bracket 14 and the frame to effect a strong, pivotal interconnection therebetween.

When the workbench 12 is in its vertical, storage position, the pivotal joint 72 will be open and the roll pin 70 exposed due to the open end of the channel frame member 20. Accordingly, to prevent foreign objects or an operator's fingers from entering the joint and being caught therein, a shield 74 is provided to enclose the open joint. The shield 74 hereof comprises a molded member which may be formed from plastic or other suitably durable materials and which is dimensioned and curved to traverse the open area between the channel frame member and the mounting bracket 14 when the workbench 12 is in its horizontal, working position as well as when in its vertical, storage position. The molded shield member 74 further comprises downwardly depending, resilient, locking key holes 76 adapted to engage the roll pin 70 to provide means for mounting the shield thereon. If desired, the shield 74 may comprise metal strips or other materials or configurations adaptable to this function.

It is to be appreciated that the outward extension 60 of the bracket 14 forms a curve radius with the associated, vertically extending portion 58 sufficiently removed from the mounting tab 68 to permit the respective, pivotally connected frame channel members to be pivoted about the axis defined by the roll pins and to be brought into substantially vertical position adjacent said vertically extending portions 58.

The mounting brackets 14 are further provided, at a point remote from said pairs of mounting tabs 68, with integrally formed lower mounting tabs 78 which are deployed on the outer sides of the brackets 14 below the outward extensions 60, perpendicular to the base members 57. Each lower mounting tab 78 is adapted to mount an associated hinge assembly 16 hereof and to provide a pivotal interconnection between said hinge assembly 16 and bracket 14.

As best seen in FIGS. 4–6 and 8, the hinge assemblies 16 hereof are identical and disposed in parallel planes. For simplicity, only one hinge assembly will be described.

Each hinge assembly has a first, upper end 80, which is pivotally interconnected with a frame channel member 20, and a second lower end 82 pivotally interconnected with the mounting bracket 14 to which its associated channel member 20 is mounted. Each hinge assembly 16 comprises an upper arm 84 and a lower arm 86, the lengths of the arms being selectively determined such that the diagonally extended hinge assembly defines the hypotenuse of the right triangle defined by the channel member 20 and the bracket 14. Each hinge assembly 16 has a bracing means, herein a weld pin and sleeve assembly 110, associated therewith which limits the movement of the extended hinge assembly past the center position in which it defines the hypotenuse of the said right angle. In this manner when fully extended to a position slightly past center, the bracing means will support the assembly rigidly in position to provide a rigidly supportive, over-center lock for the workbench 12. Thus, the hinge assemblies are dimensioned to support the workbench 12 rigidly in its work position, perpendicular to the mounting bracket by means of an "over-center lock" indicated generally at 89 and, moreover, to collapse to permit the workbench 12 to be brought into a substantially vertical position, adjacent the brackets 14 for storage.

The upper and lower hinge arms 84, 86 are constructed from metal of suitably heavy gauge. The upper hinge arms 84 comprise integrally formed, generally U-shaped, channel members having upstanding wall portions 90 interconnected by a bight member 92. The upper hinge arm 84 is pivotally connected to its associated frame channel member 20 by means of a rivet 94 or other suitable mounting means, extending through complementary, aligned apertures provided in the frame channel members and upper hinge arms.

The lower hinge arms 86 comprise integrally formed, generally U-shaped channel members having upstanding wall portions 96 interconnected by bight portion 98. The upper and lower hinge arms 84, 86 are pivotally interconnected, each arm being provided with an aperture (not shown) through its bight portion, the apertures on the upper arm 84 being positioned to be brought into alignment with the aperture on its associated lower arm, said apertures receiving coupling means such as rivets 102 therethrough to effect a pivotal interconnection therebetween.

It is to be appreciated that each hinge assembly 16 is of sufficient strength and rigidity, due to its material, composition and configuration, to maintain the workbench 12 in its perpendicular, working position alone, independent of the condition of the other hinge assembly. The over-center locking configuration of the hinge assemblies 16 defines a first locking means for providing said rigid independent support. Moreover, each hinge assembly is provided with second locking means, which coact with means provided on associated release levers 106 to provide a self-actuating lock mechanism, indicated generally at 104 to prevent accidental release of the over-center locked hinge assembly by jarring or similar events.

Figure 9:
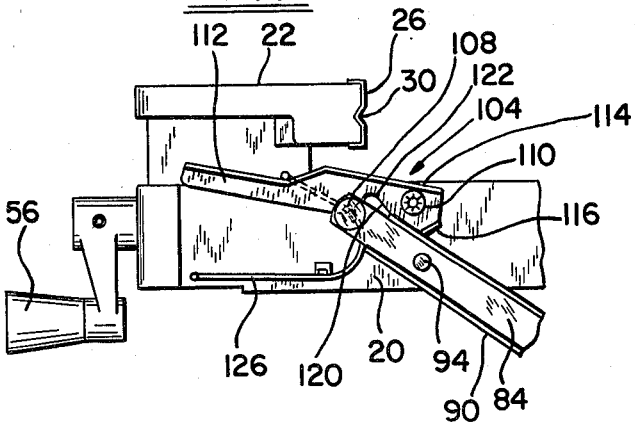
FIG. 9 is a side view of the locking means and release lever hereof in release position.

As best seen in FIGS. 8 and 9, each upper hinge arm 84 is provided with a locking pin 108, proximate the upper end thereof. Each locking pin extends perpendicularly from its hinge arm 84 and may be integrally formed therewith or mounted in an aperture provided in the hinge arm and affixed by such means as spot welding.

Each release lever 106 is pivotally mounted to its associated frame member 20 by pivotal mounting means, herein the weld pin and sleeve assembly 110, extending through complementary aligned apertures (not shown) provided therein. Each lever 106 comprises a first, sidewall portion 112, extending in a plane generally parallel to the plane of its associated hinge assembly, and a second, upper member 114 which extends out from the first portion 112 and is generally perpendicular thereto and (as shown in FIG. 1) is located below the respective laterally-extending or overhanging portion of the front stationary vise jaw 22. It is intended that the upper portion 114 define a handgrasp, accessible from the front or sides of the workbench 12 to lift the lever 106 in juxtaposition to the first stationary vise member and to the crank members, pivotally about the axis defined by the weld pin and sleeve assembly 110, and upwardly toward the stationary vise jaw 22 as shown more clearly in FIG. 9.

Figure 5:
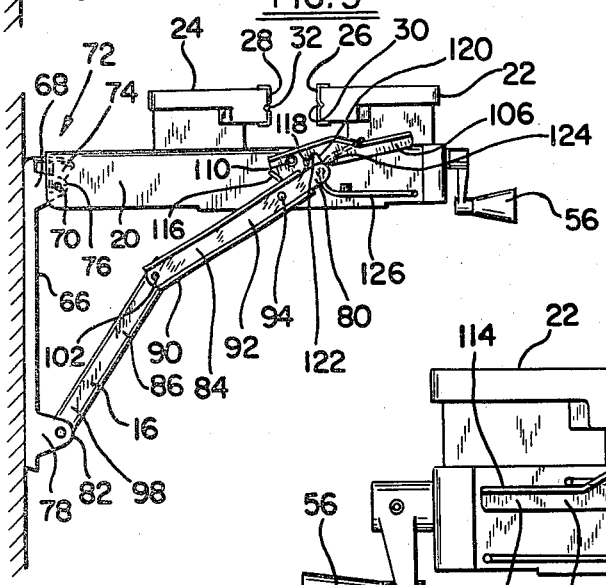
FIG. 5 is a side view of the assembly hereof, released from working position.

The rearward portion of each release lever is further provided with a protrusion such as a bent back tab 116, as best seen in FIG. 5, which tab may be formed integrally with or welded to the sidewall portion 112 of the lever 106. Each release tab 116 is positioned to urge against its associated upper hinge arm 84 when the release lever 106 is pivotally lifted to bring the associated hinge assembly out of its over-center locking position and, thereby, to allow the hinge assembly to be collapsed and the workbench 12 lowered, as will be explained more fully hereinbelow.

The sidewall portion 112 of the lever 106 is further provided with a latching slot 118 in its intermediate portion, as shown more clearly in FIG. 9. The latching slot 118 is positioned in alignment with the locking pin 108 and is configured to receive same. More particularly, the latching slot hereof is generally tapered having a wide mouth, cam surface 120 and terminating in a narrowed, irregularly shaped locking portion 122. Locking portion 122 is positioned to receive locking pin 108, and is provided with an inwardly extending locking shoulder 124.

It is to be appreciated that the locking pin 108 extends transversely of the lever sidewalls 112 and so limits the downward path of the release levers 106.

As the hinge assembly 16 is extended, the locking pin 108 enters into the latching slot 116, following the cam surface 120, and is received into the locking portion 122 thereof. The locking pin 108, positioned within the locking portion 122, supports the release lever 106 which rests thereon and is, locked within the locking portion 122 by the shoulder 124 which extends partially therebeneath, about the forward portion thereof. Thus, the locking pin 108 is locked rigidly within the locking portion 122 by means of the shoulder 124 which extends therebeneath to provide said self-actuating locking mechanism 104; inadvertent jarring of the hinge assembly 16 or similar events will not free the locking pin as collapsing, pivotal movement of the upper hinge arm 84 will merely urge said locking pin 108 downward into a more rigid engagement with the shoulder 124 extending therebeneath.

Release of said self-actuating lock 104 of hinge assembly 16 is achieved by lifting the forward portion of the associated release lever 106 upwardly towards the stationary vise member 22. When lifted, as shown in FIG. 9, the release lever pivots upwardly about the axis defined by its weld pin and sleeve assembly 110. This pivotal movement causes the shoulder 124 of the locking portion 122 of the latching slot 118 to be urged around and lifted clear of its associated locking pin 108 to free same for downward movement, thereby permitting the hinge assembly 16 to be collapsed.

The rigidity of the self-actuating lock 104 hereof is further augmented by providing resilient or spring means 126 for urging the release lever 106 into its generally horizontal, locked position, bearing against the locking pin 108. The spring means 126 may comprise a wire spring, extending along and over the release lever and along and through the associated channel frame member, and is configured to urge the release lever 106 against the locking pin 108. In this manner, the spring 126 acts to oppose lifting of the release lever 106 and so requires directed action to effect said lifting, thereby to prevent inadvertent, accidental release of the locked hinge assembly.

The upward, pivotal movement of the release lever 106 brings its release tab 116 into abutment with its associated upper hinge arm 84. As each lever 106 is raised, the release tab 116 urges against the upper hinge arm 84 causing said arm to pivot about its weld pin and sleeve assembly connection with its respective frame member 20. This pivotal movement of the upper arm 84 causes the upper arm to pivot about its interconnection with its lower arm. Accordingly, the hinge assembly 16 knees up at the connection between the upper and lower arms, as shown in FIGS. 5 and 6, and the hinge assembly is brought out of its over-center, locking position and through the center position, thus permitting the workbench 12 to be lowered.

However, if either hinge assembly is locked, collapse of the workbench in accordance herewith is precluded even though the other hinge assembly may be unlocked. Therefore, to effect collapse of the hinge assemblies and lowering of the workbench, both assemblies must be released and lowered by means of release levers 106.

Moreover, it is to be noted that release of both the over-center lock 89 and the self-actuating locking means 104 is achieved by action of the release lever 106. In this manner, the workbench 12 may be lowered to its storage position easily and conveniently, by grasping the hand grasps 114 of the release levers 106 and lifting both levers 106 up to release the self-actuating locks 104 and the overcenter locks 89 of their respective hinge assemblies, and then allowing the workbench 12 to return under gravity to its substantially vertical position. When grasping the release levers, an operator will further be in an excellent position wherein his hands will be safely removed from the collapsing hinge assemblies and wherein he can control the lowering of the workbench under gravity.

Figure 6:
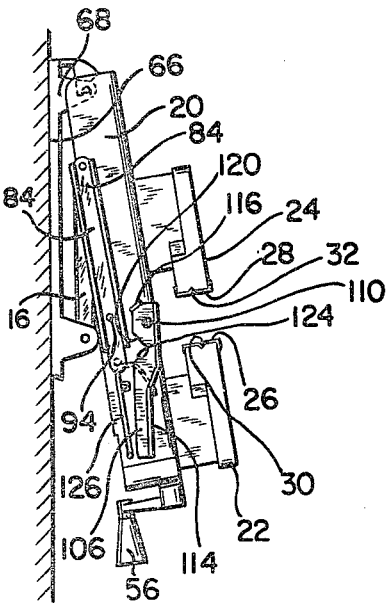
FIG. 6 is a side view hereof in its non-working storage position.

When collapsed in accordance herewith, the workbench 12 is brought into a generally vertical position, as shown in FIG. 6, closely adjacent the mounting brackets 14, wherein the support members and the vise members carried thereby are substantially nested against the wall. In this position, the workbench 12 may be easily and conveniently stored requiring no floor or table space. When it is desired to use the workbench, 12, the workbench may be brought into its working position simply by raising the forward portion thereof until the workbench is substantially perpendicular to the mounting brackets and the hinges, fully extended and locked over center.

The vertically mounted workbench hereof provides a sturdy workpiece supporting and clamping device which requires no floor or table space for use or for storage. Many modifications and adaptations of the preferred embodiment described hereinabove may be implemented, all falling within the scope of the appended claims.

What is claimed is:

1. A workpiece support and clamping assembly comprising, in combination, a pair of spaced-apart support members, means for pivotably mounting the support members to a wall or other vertical surface, a stationary vise member secured on top of the support members transversely thereof, a movable vise member arranged transversely on top of the support members, means including a pair of independently-operable crank members carried by the support members for moving the movable vise member towards and away from the stationary vise member, whereby a workpiece may be clamped between the vise members, means including respective pairs of upper and lower hinge arms pivotably connected together for retaining the support members in a horizontal position, means for pivotably connecting the respective lower arms to the wall, means for pivotably connecting the respective upper arms to the support members, locking means for retaining the hinge arms in an extended position relative to each other, wherein the hinge arms are disposed diagonally with respect to the support members and to the wall, and manually-manipulatable means selectively operable to disengage the locking means for pivoting the respective hinge arms from their extended diagonal position, wherein the support members and the vise members carried thereby are in their horizontal working position, into a folded position relative to one another, wherein the support members and the vise members carried thereby are substantially nested against the wall in a non-working storage position, said manually-manipulatable means including a pair of resiliently-biased release levers pivotably mounted on the respective support members and disposed thereon in juxtaposition to the stationary vise member and to the respective crank members for convenient engagement by the operator, whereby the release levers exert a mechanical advantage, and whereby both release levers must be engaged to allow the respective pairs of hinge arms to be moved into their folded position.

2. A workpiece support and clamping assembly comprising, in combination, a pair of spaced-apart support members, means for pivotably mounting the support members to a wall or other vertical surface, a front stationary vise member secured on top of the support members transversely thereof, a rear movable vise member arranged transversely on top of the support members, means including at least one crank member for moving the movable vise member towards and away from the stationary vise member, whereby a workpiece may be clamped between the vise members, means including respective pairs of upper and lower hinge arms pivotably connected together for retaining the support members in a horizontal position, means for pivotably connecting the respective lower arms to the wall, means for pivotably connecting the respective upper arms to the support members, means for retaining the hinge arms in an extended position relative to each other, wherein the hinge arms are disposed diagonally with respect to the support members and to the wall, and manually-manipulatable means selectively operable to disengage said last-named means for pivoting the respective hinge arms from their extended diagonal position, wherein the support members and the vise members carried thereby are in a horizontal working position, into a folded position relative to one another, wherein the support members and the vise members carried thereby are substantially nested against the wall in a non-working storage position, said manually-manipulatable means comprising a pair of resiliently-biased release levers pivotably mounted on the respective support members below the stationary vise member, each release lever having forward, rearward and intermediate portions, respectively, cooperating locking means between the upper hinge arm and the intermediate portion of the respective release lever, and release means carried by the rearward portion of the respective release lever, whereby the forward portion of each release lever may be manually pivoted upwardly relative to the support members and in a direction towards the stationary vise member, thereby disengaging the locking means and causing the release means on the rearward portion of the release lever to directly engage the upper hinge arm and pivot the respective hinge arm towards its folded position, whereby the release levers exert a mechanical advantage, and whereby both release levers must be engaged to allow the respective pairs of hinge arms to be moved into their folded position.

3. A workpiece support and clamping assembly comprising, in combination, a pair of spaced-apart support members, means for pivotably mounting the support members to a wall or other vertical surface, a front stationary vise member secured on top of the support members transversely thereof, a rear movable vise member arranged transversely on top of the support members, means including at least one crank member for moving the movable vise member towards and away from the stationary vise member, whereby a workpiece may be clamped between the vise members, means including at least upper hinge arms, one on each side of the assembly, for retaining the support members in a horizontal position, means for pivotably connecting the respective arms to the support members, means for retaining each hinge arm in an extended diagonal position with respect to the support members and to the wall, and manually-manipulatable means selectively operable to disengage said last-named means for pivoting the respective hinge arms from their extended diagonal position, wherein the support members and the vise members carried thereby are in their horizontal working position, into a folded position, wherein the support members and the vise members carried thereby are substantially nested against the wall in a non-working storage position, said manually-manipulatable means comprising a pair of resiliently-biased release levers pivotably mounted on the respective support members below the stationary vise member, each release lever having forward, rearward and intermediate portions, respectively, cooperating locking means between the hinge arm and the respective release lever, said locking means comprising a pin carried by the hinge arm and a cam slot formed in the intermediate portion of the release lever, whereby the pin is further cammed into the slot whenever a load is placed on the vise members and support members, thereby precluding an inadvertent collapse of said assembly, and a bent tab formed integrally on the rearward portion of the respective release lever, whereby the forward portion of each release lever may be pivoted upwardly relative to the support members and in a direction towards the stationary vise member, thereby disengaging the locking means and causing the tab on the rearward portion of the release lever to directly engage the respective hinge arm and pivot the hinge arm towards its folded position, whereby the release levers exert a mechanical advantage, and whereby both release levers must be engaged to allow the respective hinge arms to be moved into their folded position.

4. A workpiece support and clamping assembly comprising, in combination, a pair of spaced-apart support members, means for pivotably mounting the support members to a wall or other vertical surface, a front stationary vise member secured on top of the support members transversely thereof and having end portions extending laterally beyond the respective support members, a rear movable vise member arranged transversely on top of the support members, means including a pair of independently-operable crank members carried by the support members for moving the movable vise member towards and away from the stationary vise member in a non-parallel relationship thereto, whereby a tapered or odd-shaped workpiece may be clamped between the vise members, means including respective pairs of upper and lower hinge arms pivotably connected together for retaining the support members in a horizontal position, means for pivotably connecting the respective lower arms to the wall, means for pivotably connecting the respective upper arms to the support members, means for retaining the hinge arms in an extended position relative to each other, wherein the hinge arms are disposed diagonally with respect to the support members and to the wall, and manually-manipulatable means selectively operable to disengage said last-named means for pivoting the respective hinge arms from their extended diagonal position, wherein the support members and the vise members carried thereby are in their horizontal working position, into a folded position relative to one another, wherein the support members and the vise members carried thereby are substantially nested against the wall in a non-working storage position, said manually-manipulatable means including a pair of resiliently-biased release levers pivotably mounted on the respective support members below the laterally-extending portions of the stationary vise member and in juxtaposition to the respective crank members for convenient engagement by the operator, each release lever having forward, rearward and intermediate portions, respectively, cooperating locking means between each upper hinge arm and a respective release lever, said locking means comprising a pin carried by the upper hinge arm and a cam slot formed in the intermediate portion of the release lever, whereby the pin is further cammed into the slot whenever a load is placed on the vise members and support members, thereby precluding an inadvertent collapse of said assembly, and a bent tab formed integrally on the rearward portion of the respective release lever, whereby the forward portion of each release lever may be manually pivoted upwardly relative to the support members and in a direction towards the stationary vise member, thereby disengaging the locking means and causing the tab on the rearward portion of the release lever to directly engage the upper hinge arm and pivot the respective hinge arms towards its folded position, whereby the release levers exert a mechanical advantage, and whereby both release levers must be engaged to allow the respective hinge arms to be moved into their folded position.

* * * * *